United States Patent [19]

McMahon

[11] 3,984,046

[45] Oct. 5, 1976

[54] INNER PACKING FOR SHIPPING FRAGILE ARTICLES

[75] Inventor: Bernard J. McMahon, Terre Haute, Ind.

[73] Assignee: The Weston Paper and Manufacturing Co., Terre Haute, Ind.

[22] Filed: Apr. 11, 1975

[21] Appl. No.: 567,072

[52] U.S. Cl. ..... 229/28 R; 229/15

[51] Int. Cl.[2] ..... B65D 5/48

[58] Field of Search ..... 229/15, 27, 28 R, 42; 217/30–34

[56] References Cited

UNITED STATES PATENTS

| | | | |
|---|---|---|---|
| 1,999,664 | 4/1935 | Reaume | 229/15 X |
| 2,751,705 | 6/1956 | Joseph | 229/15 X |
| 2,844,294 | 7/1958 | Williams | 229/15 X |
| 2,955,735 | 10/1960 | Inman et al. | 229/28 R |

*Primary Examiner*—William Price
*Assistant Examiner*—Stephen Marcus
*Attorney, Agent, or Firm*—Biebel, French & Nauman

[57] ABSTRACT

Separator means for a shipping container formed from a single paperboard blank having a pattern of cut, fold and perforation lines such that the walls are reinforced to withstand side loads and the interior packing space is divided by dividers of different sizes and shapes which can be assembled in multi-configuration arrangements to provide separate packing cells of selected dimensions as needed for the particular articles to be shipped.

9 Claims, 15 Drawing Figures

INNER PACKING FOR SHIPPING FRAGILE ARTICLES

BACKGROUND OF THE INVENTION

It has been common to provide a shipping container with dividers for forming individual packaging cells but where reinforcement of the side walls was involved separate elements were needed and in some cases the arrangement was such that the parts could be assembled in only one configuration from a single blank.

SUMMARY OF THE INVENTION

The invention provides a packaging system including a separator which when set up provides reinforced side walls, does not require any form of fastener, has no waste, and which though formed from a single uniform shaped blank with divider means integral therewith, can be assembled by the packer in a number of configurations to provide individual article receiving cells for receiving fragile articles of widely different sizes and shapes.

BRIEF DESCRIPTION OF THE DRAWINGS

Referring to the drawings.

DESCRIPTION OF THE PREFERRED EMBODIMENT

Figure 12:
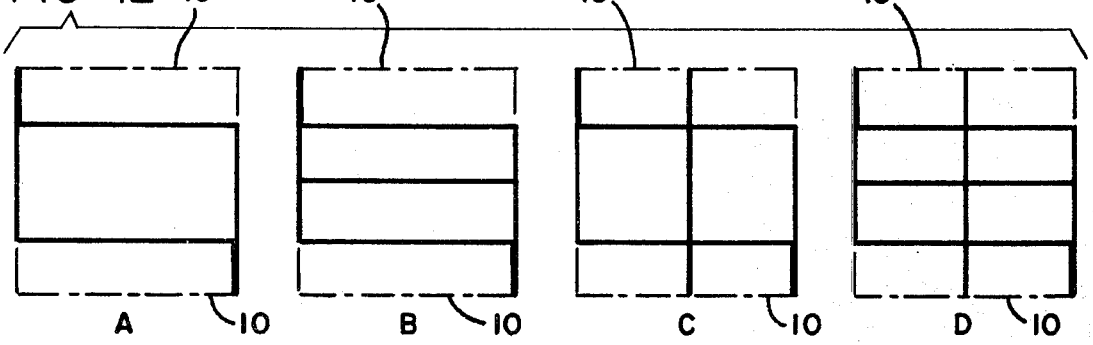
FIGS. 12A through D are plan views looking down upon the separator with a series of different divider configurations.
Figure 13:
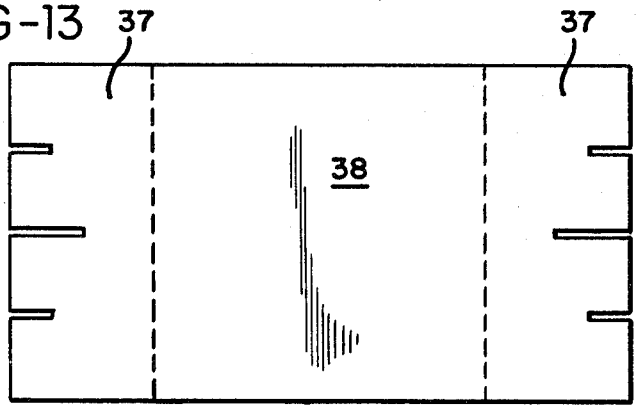
FIG. 13 is a view of the dividers and floor panel section as removed from the right-hand side of the blank.
Figure 1:
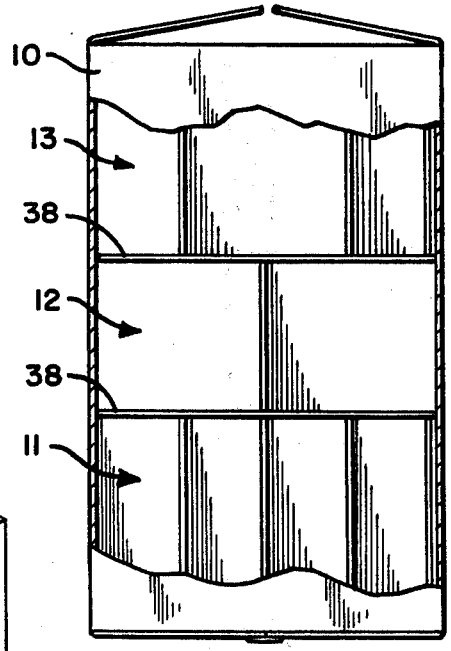
FIG. 1 is an end view of the finished shipping container showing one configuration of the separators.
Figure 14:
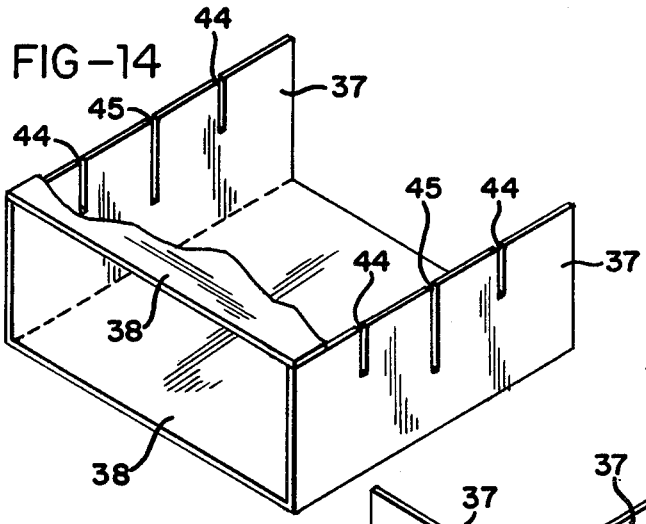
FIG. 14 is a perspective view of one arrangement of dividers on a floor panel 38.
Figure 15:
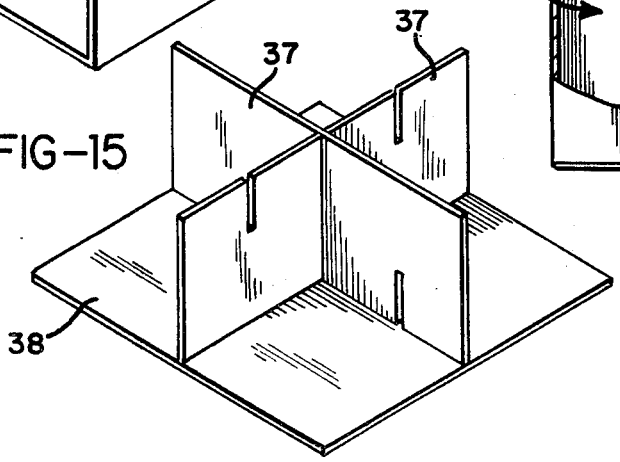
FIG. 15 is a view of a different divider arrangement.

A conventional paperboard container 10 is rectangular in form having, for example, dimensions of 18 inches by 18 inches by 30 inches. In this view there is shown an arrangement of a tall separator 11 on top of which is a short divider 12 and on top of that is a second tall separator section 13. It will be quite evident that this provides for the short separator 12 to be in the middle as shown, above the lower tall separator 11, or below the upper tall separator 13, as may be found most suitable and convenient by the packer. It will be understood that two identical blanks as shown in FIG. 2 will provide all the necessary separators and dividers for making up the complete packaging system in any desired configuration as described.

Figure 2:
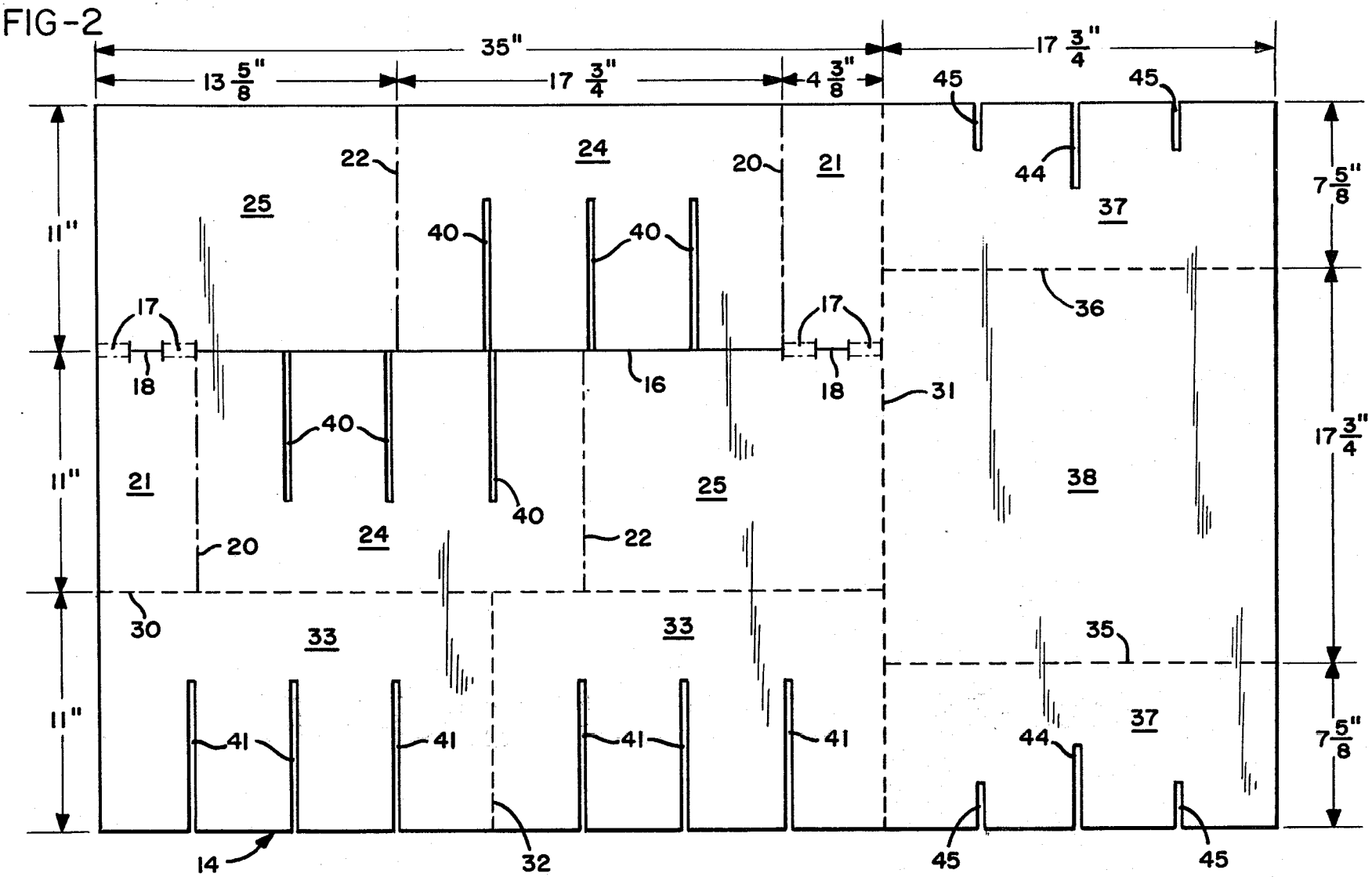
FIG. 2 is a view of the blank from which the separators and the dividers as well as the floor panels are formed.
Figure 3:
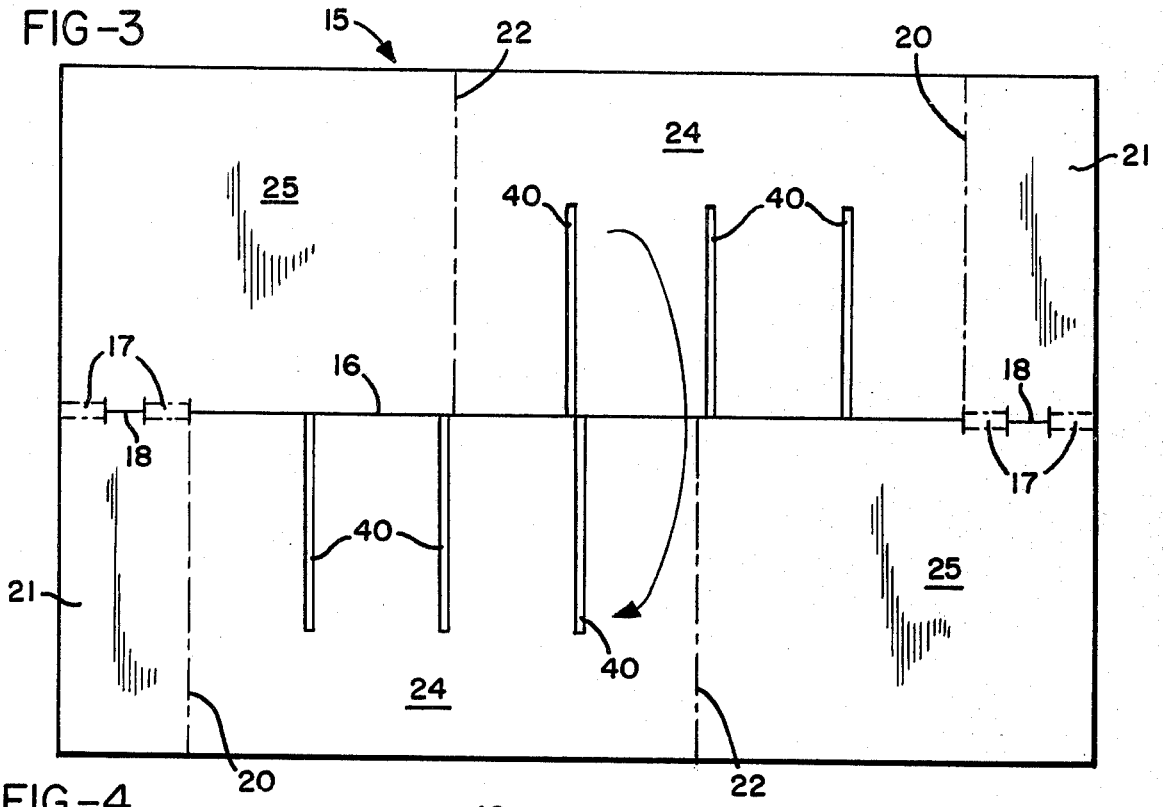
FIG. 3 is a view showing the main body portion in flat form.

Referring to FIG. 2 the shape of the blank 14 for forming the separator and all dividers both short and tall is illustrated together with typical dimensions of each section to provide for completing any of the three arrangements described immediately above. The main body portion of the separator is shown in FIG. 3 comprising a rectangular section 15 forming part of blank 14 and having a central cut line 16 extending toward but terminating short of the ends of the blank to leave outer hinge areas 17. To facilitate bending, a short cut line 18 between the two hinge areas 17 may be provided. The main body portion has fold lines 20 on opposite sides of and extending in opposite directions from the cut 16 which define narrow reinforcing panels 21 on opposite sides of and extending oppositely from the cut line 16. The main body portion has additional fold lines 22 on opposite sides of the cut line which define symmetrically arranged side wall panels 24 and end wall panels 25 on opposite sides of the cut line.

Referring again to FIG. 2, in addition to main body portion 15 there is a perforation line 30 along one side of the main body portion and a similar perforation line 31 along an end at right-angles to the first edge of the main body portion. A perforation line 32 defines two tall divider panels 33 while perforation lines 35, 36 define two short divider panels 37 at the corners of the blank with a floor panel 38 therebetween. It will be understood that these perforation lines provide for folding each section upon itself or separating one portion from the other to obtain the particular configuration desired. Each of the side wall panels 24 is provided with a pattern of slots 40, preferably three in number, while tall divider panels 33 have long slots 41, again preferably three in number, and short divider panels 37 have a pattern of a long slot 44 and two short slots 45.

Figure 4:
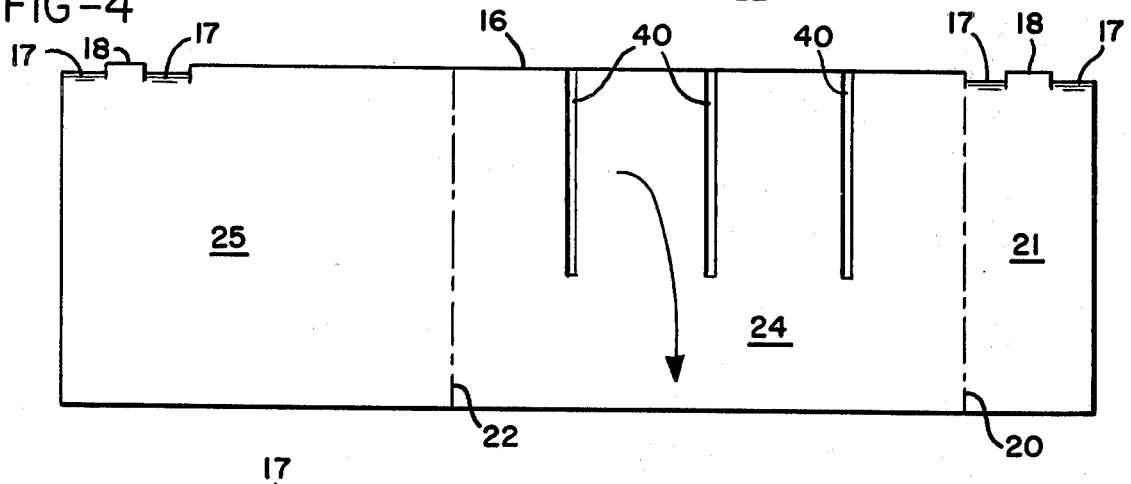
FIG. 4 is a view showing the main body portion folded upon itself.
Figure 5:
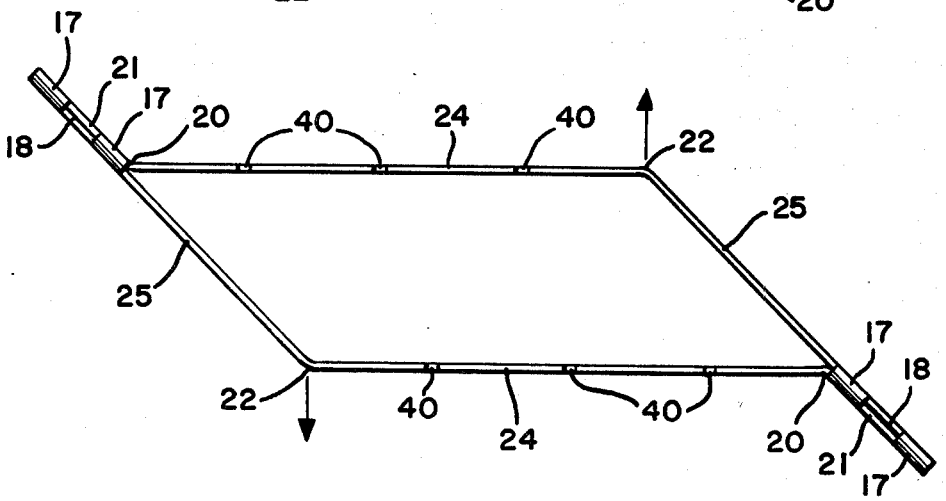
FIG. 5 is a plan view of the main body portion in partially erected condition.
Figure 6:
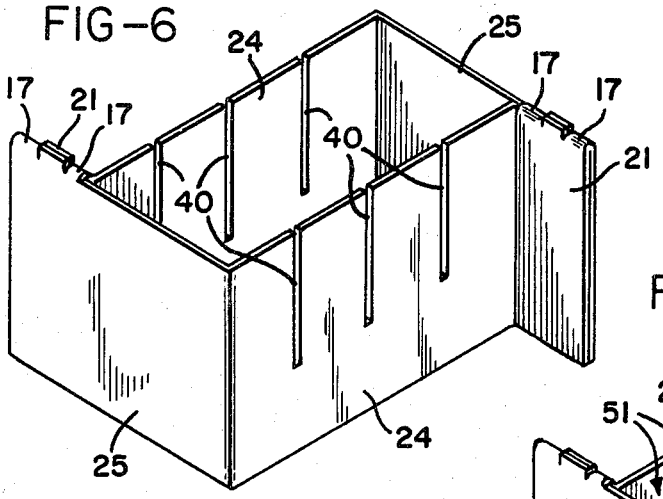
FIG. 6 is a view in perspective of the main body portion in fully erected condition.
Figure 7:
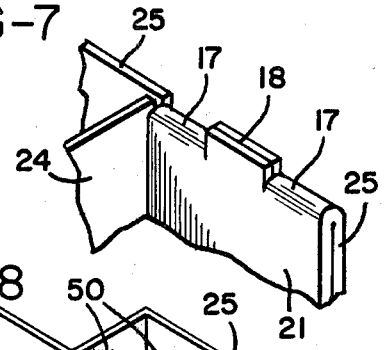
FIG. 7 is a broken detail view showing the hinge and reinforcing arrangement of the main body portion.

The first step in assembling is to break off the divider panels from the main body portion along perforation lines 30 and 31. This leaves the main body portion in the form illustrated in FIG. 3. The next step then is to fold the main body portion upon itself along cut line 16 and fold lines 17 thus producing the folded main body in the shape shown in FIG. 4. When this shape is partially erected it appears as shown in FIG. 5, the erection then being completed to result in the shape shown in FIG. 6 where it is fully erected. At this point, and by reference to FIG. 7, it can be seen that the hinges 17 provide for each reinforcing panel 21 to be in face-to-face contact with its adjacent end wall panel 25, this position being self-locking without the need for fasteners by reason of the frictional engagement of the reinforcing panels 21 with the side wall panels 24. It has been found that this reinforcement, providing a double wall thickness at the opposite diagonal corners of the separator, provides substantial strength against loads applied to the side of the container such that the container lying on its side will easily support the weight of a person.

Figure 8:
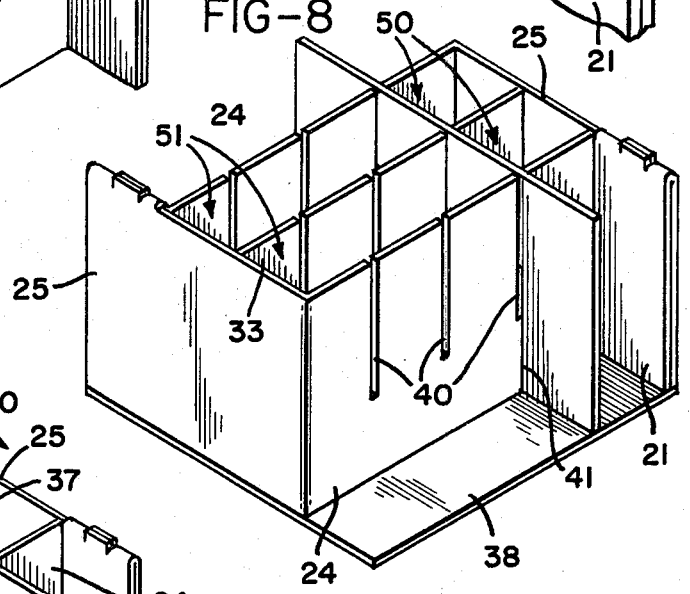
FIG. 8 is a view of the separator with the dividers arranged in one configuration.

FIG. 8 shows a configuration of a tall divider panel 33 with its slot 41 interfitting with the slots 40 of the two side wall panels 24 and with another intermediate tall divider panel 33. This configuration provides four narrow cells 50 and four longer cells 51.

Figure 9:
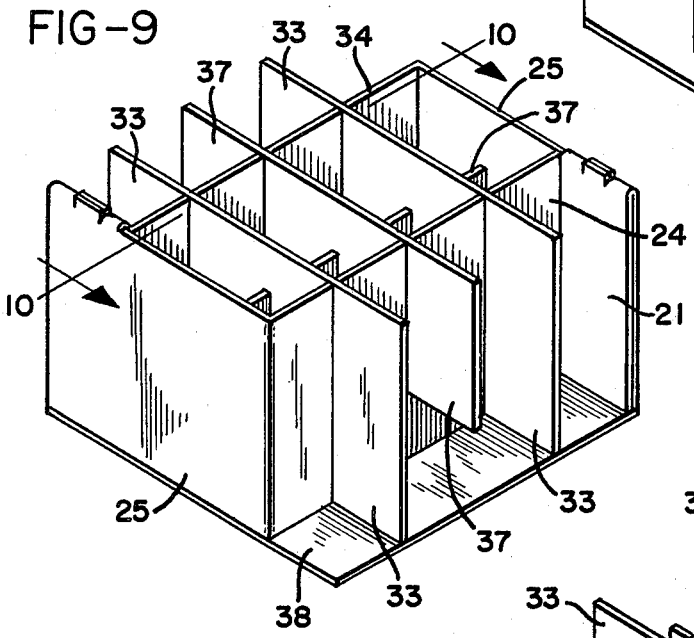
FIG. 9 is a view of the separator and dividers arranged in a different configuration.
Figure 10:
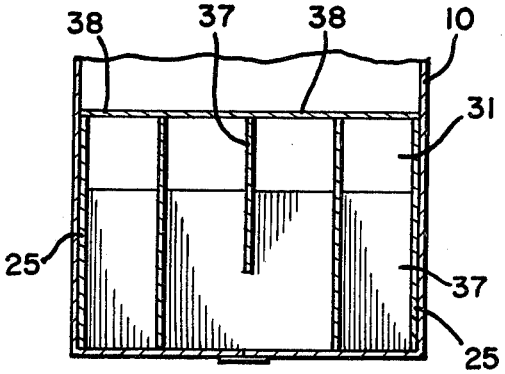
FIG. 10 is a view in section on line 10—10 of FIG. 9.

FIGS. 9 and 10 show another configuration using two short dividers 37 and two tall dividers 33 forming a useful pattern of large and small cells.

Figure 11:
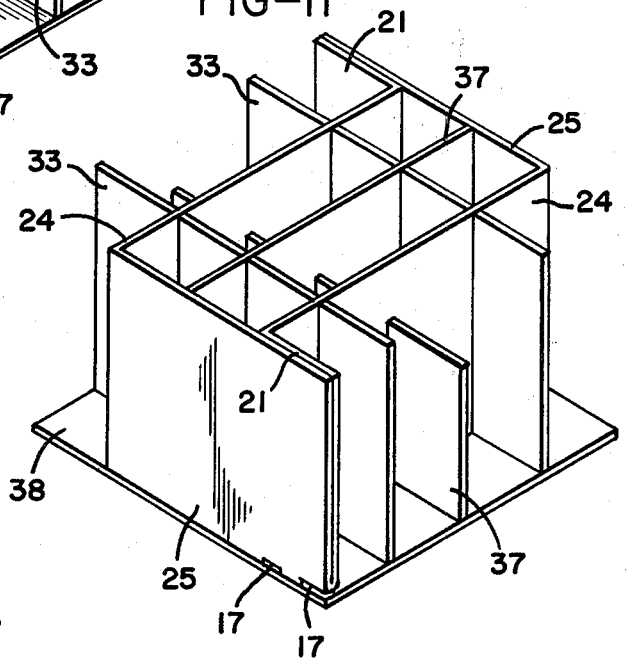
FIG. 11 is a view showing that the separator and dividers can also be assembled and used in inverted position.

It will be apparent from FIG. 11 that the separator and dividers can be inverted to provide appropriate configurations as may be desired.

From the above it will be apparent that by using a single form of blank having the fold and perforation lines as described above, a packaging system is provided so that the packer can assemble the parts into many configurations to provide cells for protecting articles of widely differing sizes and shapes, and without the need for additional packing or dividers beyond those available from the two full blanks as shown in FIG. 2. The packer has complete flexibility while at the same time being assured that each package will be properly reinforced can be assembled without the need for tools or fasteners, entails essentially no waste, and requires no supply of auxiliary packing material beyond that available from the blanks themselves.

While the articles herein described constitute preferred embodiments of the invention, it is to be understood that the invention is not limited to these precise articles, and that changes may be made therein without departing from the scope of the invention which is defined in the appended claims.

What is claimed is:

1. A paperboard container for shipping a plurality of fragile articles comprising a rectangular box-like structure, and separator main body means formed from a single rectangular sheet of paperboard having in blank form a center cut line extending parallel to the longitudinal dimension of said sheet and terminating short of the ends and defining a side wall panel and an end panel on each side of said cut line, fold lines defining a narrow reinforcing panel on each side of said cut line at adjacent opposite sides of each side panel, each said end panel forming an end wall of said separator, each end panel being integral with the adjacent side panel and joined thereto by a fold line, said entire sheet being folded upon itself about said center cut line and said fold lines to form an upright separator having each reinforcing panel in contact with the opposite end panels to form a double thickness integral end panel at each end and a central open packing space between said side panels.

2. A separator blank for a shipping container comprising a main body formed from a single rectangular sheet of paperboard having a central cut line extending parallel to the longitudinal dimension of said sheet and terminating short of the ends and defining a narrow reinforcing panel on opposite sides and opposite ends of said cut line, a side wall panel, and an end panel on each opposite side of said cut line, said side panel positioned between an adjacent reinforcing panel and an adjacent end panel, and fold lines between adjacent panels and outwardly of the ends of said cut line providing for folding said sheet upon itself to form an upright separator member having double thickness integral end panels at opposite ends and spaced side wall and end walls providing a packing space when erected, said sheet further having means for positioning divider panels across said packing space, said means comprising at least one pair of slots which extend laterally of said cut line and terminate short of the edges of said sheet.

3. A blank for a separator as defined in claim 2 including two tall divider panels formed integrally with one edge of the separator blank, two short divider panels and a floor panel formed integrally with the separator blank along an edge at right angles to said first edge, said divider panels and said floor panel being connected to the separator panel and to each other by perforations providing for separation of said divider panels to divide the space within said separator into a plurality of individually protected cells.

4. A blank as defined in claim 3 in which each divider panel is slotted part way through its depth providing for the interfitting of said dividers to form said individual protected cells.

5. A blank for use in forming a multi-configuration separator for use in a shipping container for articles of different size and shape requiring protection comprising a single rectangular flat sheet of paperboard, said sheet having a main body portion, first and second divider forming portions integral with a side and an end of said main body portion respectively and separated therefrom by perforation lines, said main body portion having a central cut line terminating adjacent but short of its ends leaving integral hinge portions, fold lines at the ends of said cut line defining hinges and a reinforcing panel at opposite ends and at opposite sides of said cut line, fold lines at the side of each reinforcing panel defining opposite side panels, fold lines at the side of each said panel defining opposite end panels, at least one perforation line in said first divider portion, at least one perforation line in said second divider portion, said main body portion being foldable on itself about said hinge portions to form a hollow enclosed packing space, said divider portions being separable from said main body portion and from each other and having interfitting slots adapted to interlock with the walls of said container and with each other to form dividers for separating said packing space into a plurality of packing cells of predetermined size and shape.

6. A blank as defined in claim 5 in which a pair of opposed walls of said main body portion contain one or more spaced slots adapted to receive the slots of said dividers and to interlock therewith in a plurality of arrangements defining packing cells of different sizes.

7. A blank as defined in claim 5 in which one pair of divider portions is of greater height than the other pair providing for selectively forming packing cells of full and less than full depth of a separator.

8. A blank as defined in claim 5 in which the second divider portions are spaced from a central portion having an area substantially the same as the cross-sectional area of the container to serve as a floor panel to separate a first group of enclosed packing cells from another such group above the first group.

9. In a packaging system for shipping a plurality of fragile articles of different sizes and shapes in a generally rectangular shipping carton, the combination of at least one separator means adapted to fill the cross-sectional area of said carton and to divide said area into a selected number of packing cells of predetermined size and shape by means of dividers, said separator means and said dividers being integral parts of a single paperboard blank having a main body portion and first and second divider portions integrally joined respectively to a side and to an end of said main body portion by perforation lines and capable of being separated therefrom, said main body portion having a central cut line terminating short of the opposite edges thereof leaving integral hinge portions at the edges, fold lines at the ends of said cut line defining narrow reinforcing panels at opposite sides of and extending in opposite directions from said cut line, additional fold lines defining a side wall panel and an adjacent end wall panel symmetrically extending from each side of said cut line, said main body panel being foldable upon itself to bring each reinforcing panel into self-locking relation with its adjacent side wall panel and upon erection forming an open rectangular packing space, said separated divider panels being interfitted with each other and with said side wall panels in a plurality of multi-configurations to divide said packing space into a number of cells of predetermined size and shape.

* * * * *